US006927368B2

(12) United States Patent
Cao et al.

(10) Patent No.: US 6,927,368 B2
(45) Date of Patent: Aug. 9, 2005

(54) METHOD AND APPARATUS FOR CONTROLLING POWER TO A HEATER ELEMENT USING DUAL PULSE WIDTH MODULATION CONTROL

(75) Inventors: Jichang Cao, Lexington, KY (US); James D. Gilmore, Lexington, KY (US); Calvin D. Murphy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 129 days.

(21) Appl. No.: 10/401,076

(22) Filed: Mar. 27, 2003

(65) Prior Publication Data

US 2004/0188416 A1 Sep. 30, 2004

(51) Int. Cl.[7] ..... H05B 1/02

(52) U.S. Cl. ..... 219/492; 219/501; 219/505; 219/216; 323/901; 399/70

(58) Field of Search ..... 219/492, 494, 219/501, 216, 497; 399/69, 70, 44, 330; 323/901, 235, 236

(56) References Cited

U.S. PATENT DOCUMENTS 4,337,388 A * 6/1982 July ..... 392/498
5,367,369 A 11/1994 Nakai et al.
5,708,920 A 1/1998 Ohnishi et al.
5,747,774 A 5/1998 Suzuki et al.
5,789,723 A * 8/1998 Hirst ..... 219/501
6,097,006 A 8/2000 Inukai
6,111,230 A 8/2000 Cao et al.
6,160,975 A 12/2000 Bartley et al.
6,519,427 B2 2/2003 Kataoka
2004/0232137 A1 11/2004 Cook et al.
2004/0245236 A1 12/2004 Cook et al.

* cited by examiner

*Primary Examiner*—Mark Paschall
(74) *Attorney, Agent, or Firm*—Stevens & Showalter, L.L.P.

(57) ABSTRACT

A method for controlling power to an electrical load using dual pulse width modulation (PWM) to minimize in-rush current to the electrical load, such as a heater element. An output from a power source, supplying an alternating current, is modulated by a first PWM control signal to provide a first modulated power level to the electrical load. The first modulated power level is modulated by a second PWM control signal to control power supplied to the electrical load at the first modulated power level. The first PWM control signal operates to control the number of half cycles of current in order to provide one-third, two-thirds or full cycle power. The second PWM control signal operates to define a duty cycle and period for providing the power defined by the first PWM control signal to the electrical load.

38 Claims, 8 Drawing Sheets

| Power Region | STANDBY | | | PRINT | | |
|---|---|---|---|---|---|---|
| | PWM Waveform (half-cycles) | PWM | | PWM Waveform (half-cycles) | PWM | |
| | | Duty Cycle | Period (sec) | | Duty Cycle | Period (sec) |
| $T_H(1)$ | 1/3 | 40% | 10 | 2/3 | 60% | 10 |
| $T_L(0)$ | 1/3 | 10% | 15 | 1/3 | 10% | 10 |

Fig. 9

METHOD AND APPARATUS FOR CONTROLLING POWER TO A HEATER ELEMENT USING DUAL PULSE WIDTH MODULATION CONTROL

BACKGROUND OF THE INVENTION

1. Field of the Invention

The present invention relates to a method and apparatus for controlling power to an electrical load. More particularly, the present invention relates to a method and apparatus for controlling power to a high power heater element in a fuser of an imaging device to provide improved warm-up and temperature control characteristics.

2. Description of Related Prior Art

In printing, the amount of time it takes for the first page of a print job to be printed and to reach the printer's output bin is known as first copy time, and is an important feature to users of the printer. In conventional electrophotographic printers, the controlling factor for first copy time typically has been the amount of time it takes to warm up a cold fuser to a target temperature for performing a fusing operation.

To optimize the first copy time, the fuser must be heated as fast as possible. In addition, it is necessary to maintain the temperature of the fuser within a narrow temperature window close to a predetermined target temperature for a given mode of operation of the fuser. These requirements impose conflicting design constraints on a heater element incorporated within a heated fuser roll. For example, it is desirable to have a relatively high power heater element to provide a fast temperature ramp up when initially heating the fuser. On the other hand, when controlling power to such a high power heater element, it is difficult to operate within a narrow temperature window, particularly when small, controlled temperature corrections are required to maintain a target temperature.

A further limitation on the operation of the heater element relates to noise reduction requirements imposed in Europe on all electrical and electronic equipment, known as the "harmonic" requirement IEC 61000-3-2, and the "flicker" requirement IEC 61000-3-3. When power is first applied to the heater element for the fuser, such as a 750 W tungsten-filament lamp or other high wattage lamp, there is typically a large inrush current that primarily produces harmonic noise and an instantaneous voltage drop that can affect other electrical equipment connected to the same or a nearby electrical branch circuit. The effect of the sudden inrush current at the heater element, and associated voltage drop, is readily noticeable as a flicker in the output of fluorescent lights. As the temperature of the heater element rises, its resistance also increases and a larger amount of energy may be applied without the substantial voltage variations experienced during initial warm-up.

One proposed solution to the flicker problem is to control a fuser by using on-off control, i.e., switching power to the fuser heater element on and off, to provide a desired temperature change in the fuser. For example, U.S. Pat. No. 6,097,006 discloses apparatus for increasing the temperature of a fuser in which a switching unit is turned on and off to intermittently disrupt the current supplied to the fuser to warm up the fuser wherein the duration of the "on" relative to the "off" time is selected to provide a desired temperature increase and to control the generation of flicker.

In an alternative approach, U.S. Pat. No. 6,111,230, assigned to the assignee of the present application, discloses a method and apparatus for energizing an electrically driven apparatus that applies power to the apparatus by using phase-angle control. Triggering of the AC power is delayed for each half cycle of the AC current waveform, and in particular is initially delayed by nearly the entire half cycle. The delay time is then decreased at a predetermined rate before triggering each subsequent half cycle until full power is reached.

There is a continuing need to provide a reduced warm-up time for fusers, and in particular to provide a reduced warm-up time for fusers in color laser printers, where the fuser rolls are commonly formed of an aluminum core coated with silicon rubber, having a lower thermal conductivity than the aluminum core, and covered with a fluoropolymer sleeve. The desired reduction in warm-up time may be achieved by providing a high power heater, for example, higher than approximately 800 watts for a single lamp system and 750 watts for a two-lamp system. However, the use of these high power heater elements is dependent on meeting the above-mentioned European harmonic and flicker requirements on electrical equipment. Further, use of such high power heater elements is additionally contingent on providing a control method capable of maintaining the fuser temperature within a narrow range of predetermined target temperatures, such as are defined by target standby and print mode temperatures.

SUMMARY OF THE INVENTION

A method of controlling power applied to an electrical load is provided by the present invention whereby the application of power meets European harmonic and flicker requirements. In particular, the present invention provides a power control method which is adapted to be used for supplying power to a fuser having a high power heater element, and operates to provide improved warm-up characteristics, as well as improved temperature control maintaining an operating temperature of the fuser within a narrow temperature window.

In accordance with one aspect of the invention, a method of controlling power to an electrical load is provided comprising supplying power from a power source; modulating an output from the power source to provide power at a first modulated power level to power the electrical load; and modulating the first modulated power level to control the power provided to the electrical load at the first modulated power level in accordance with a second modulated power level.

In accordance with another aspect of the invention, a method of controlling power to a heater element is provided comprising supplying AC current from a power source; producing a waveform pulse width modulation control signal to define a first modulated power level to power the heater element; and producing a duty cycle pulse width modulation control signal to define a second modulated power level to control application of the first modulated power level to the heater element.

In accordance with yet another aspect of the invention, a method of controlling power to a heater element is provided comprising supplying power from a power source; sensing a temperature controlled by the heater element; comparing the sensed temperature to a predetermined temperature; supplying power to the heater element in accordance with a first switching signal providing a first set of power level control parameters when the sensed temperature is below the predetermined temperature; and supplying power to the heater element in accordance with a second switching signal providing a second set of power level control parameters when the sensed temperature is above the predetermined temperature wherein the power supplied to the heater element in accordance with the second set of power level control parameters is reduced from the power supplied by the first set of power level control parameters.

In accordance with still another aspect of the invention, a method of controlling power to an electrical load is provided comprising supplying power from a power source; controlling supply of the power to an electrical load in accordance with a duty cycle pulse width modulation signal for providing a periodic application of power at a predetermined power level; providing a preheat defined by a lower power level than the predetermined power level; and wherein the preheat is provided prior to individual periods of the periodic application of power.

In accordance with a further aspect of the invention, a method of controlling power to a heater element in an electrical device is provided comprising supplying power from a power source to said heater element; defining a high threshold temperature for said electrical device; determining a temperature of said electrical device above said high threshold temperature to define a low power region; and continuing to supply power to said heater element in said low power region while causing a decrease in the temperature of said electrical device.

In accordance with still a further aspect of the invention, a method of controlling a heater element in an electrical device is provided comprising defining a target temperature for said electrical device; and supplying power from a power source to heat said electrical device from substantially a room temperature wherein said power is applied at a first power level during a first stage up to a first predetermined temperature less than said target temperature, said power is supplied at a second power level, less than said first power level, during a second stage up to a second predetermined temperature greater than said first predetermined temperature and less than said target temperature, and said power is applied at a third power level, less than said second power level up to said target temperature.

In accordance with yet a further aspect of the invention, heating control apparatus for connecting and disconnecting AC power from an AC power source at zero crossings of the AC power is provided comprising a switching device that is selectively turned on and off; a heater element connected to the AC power source via the switching device; a zero-cross driving circuit for driving the switching device at zero-cross points of the power source; and control means providing a dual pulse width modulation control signal for controlling the driving circuit, the signal being asynchronous with the AC power whereby the switching device is turned on and off for half cycles of the AC power corresponding to the signal, the dual pulse width modulation control signal comprising a first waveform component providing selected half cycles of the AC power, and a second duty cycle/period signal component providing the selected half cycles of the AC power for a selected duty cycle portion of a time period.

Other features and advantages of the invention will be apparent from the following description, the accompanying drawings and the appended claims.

BRIEF DESCRIPTION OF THE DRAWINGS

FIG. 9 is a chart of the power control parameters for a high power region and low power region of operation for a heating element in a fuser;

DETAILED DESCRIPTION OF THE PREFERRED EMBODIMENTS

Figure 1:
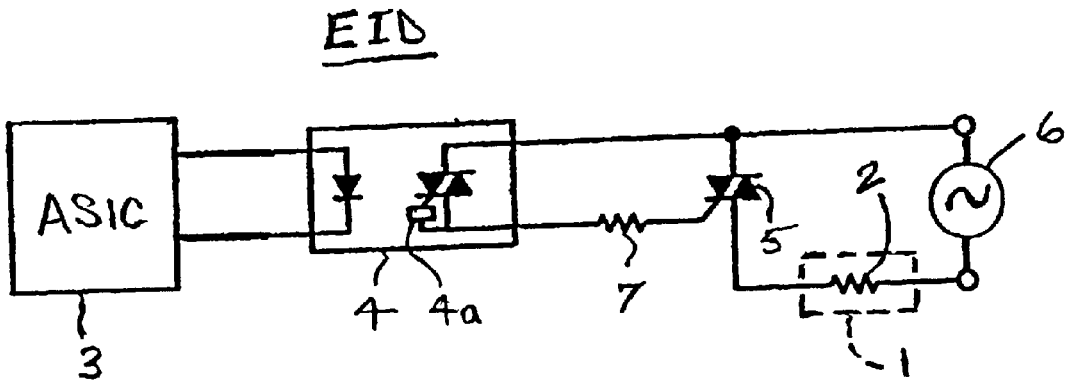
FIG. 1 is a diagrammatic view of a portion of an electrophotographic imaging device for implementing the present invention.

The present application provides a method of controlling a high power heater element in an electrical device. As a non-limiting example presented for illustration of the operating principals of the present application, the electrical device may comprise a fuser 1 such as is provided in an electrophotographic imaging device (EID), a portion of which is shown in FIG. 1, and the high power heater element 2 may comprise a tungsten lamp or equivalent heater having a power rating in the range of approximately 800 W–1000 W. The heater element 2 is controlled from a controller 3 of the EID, illustrated as an application specific integrated circuit (ASIC). Signals generated by the controller 3 in accordance with the method of the present application are passed to a zero-cross optoisolator triac driver circuit 4 including a zero crossing circuit 4*a*, such as an MOC3163 commercially available from Fairchild Semiconductor, which drives a power triac 5 to connect AC power from a source of AC power 6 to the heater element 2. A resistor 7 limits the current drawn by the driver circuit 4.

As will be described in further detail below, AC power is supplied to the heater element 2 using one of a plurality of waveforms, first modulated power levels, as selected by a first pulse width modulation (PWM) control signal or waveform PWM control signal. Each waveform is defined by a waveform length and a waveform power segment, the waveform length comprising a predetermined number of half cycles and the waveform power segment comprising a selected number of the half cycles of the waveform length during which power is supplied to the heater element. Each of the plurality of waveforms provide a discrete power level that is periodically repeated based on a period equal to the waveform length. In a prototype embodiment of the power control of the present application, a waveform length of up to fifteen could be selected such that fifteen waveform power segments, ranging from one-out-of-fifteen half cycles to fifteen-out-of-fifteen half cycles, could be selected. It is contemplated that any reasonable waveform length could be used, i.e., a waveform length equal to a number of half cycles greater than or less than fifteen.

In the illustrated embodiment of the present application, waveform length was selected as three so that the plurality of waveforms provide three discrete power levels that are periodically repeated on a period of three half cycle segments of the cyclical AC power waveform and comprise: 1) a one-out-of-three half cycle waveform 10 (FIG. 2), as controlled by a 1/3 waveform PMW control signal 12 where power is supplied to the heater element one-out-of-three half cycles to provide one third power; 2) a two-out-of-three half cycle waveform 14 (FIG. 3), as controlled by a 2/3 waveform PMW control signal 16, where power is supplied two-out-of-three half cycles to provide two thirds power, and; 3) a three-out-of-three half cycle waveform 18 (FIG. 4), as controlled by a full or 3/3 waveform PWM control signal 20, where power is supplied three-out-of-three half cycles to provide full power.

Figure 2:
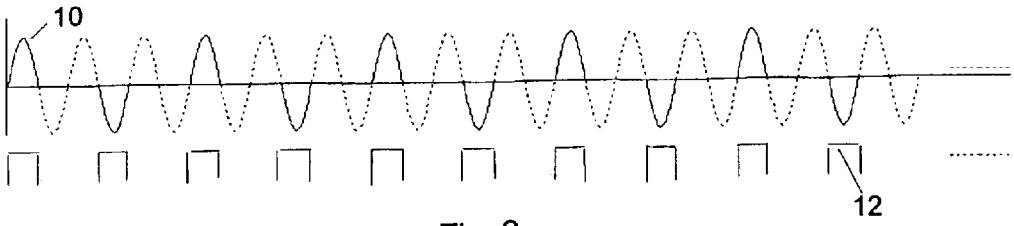
FIG. 2 illustrates a first, one-third power, current waveform provided by a first, waveform pulse width modulation control signal of the present invention.
Figure 3:
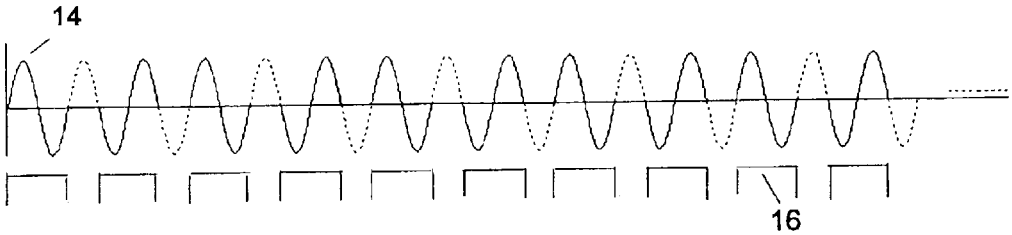
FIG. 3 illustrates a second, two-thirds power, current waveform provided by the first, waveform pulse width modulation control signal.
Figure 4:
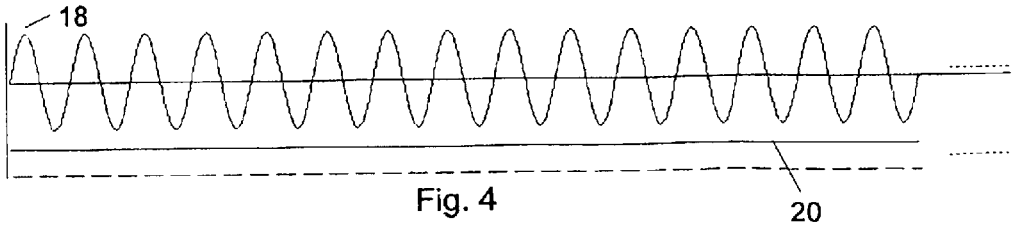
FIG. 4 illustrates a third, full power, current waveform provided by the first, waveform pulse width modulation control signal.
Figure 5:
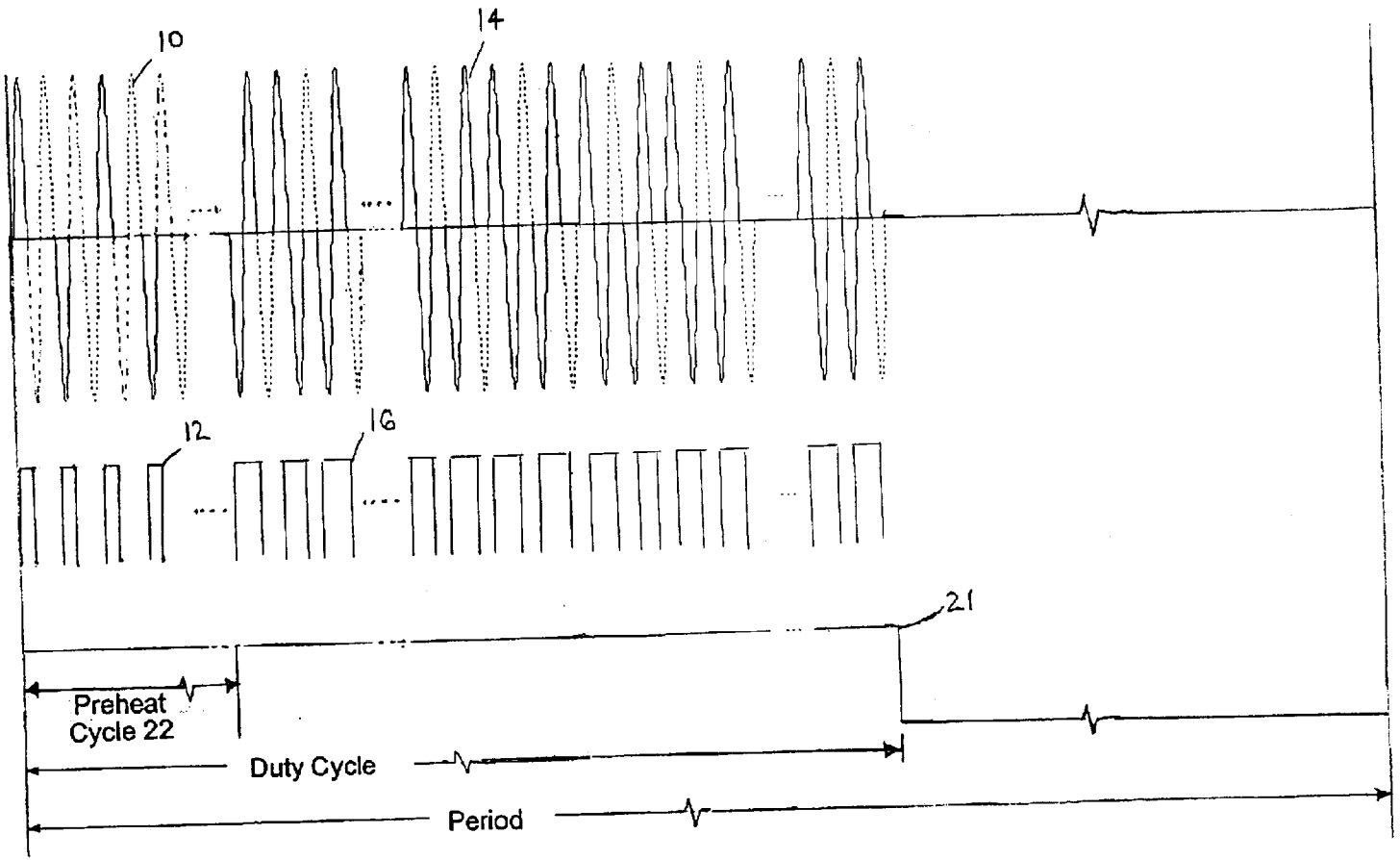
FIG. 5 illustrates the relationship between the current waveform and the waveform pulse width modulation control signal and the duty cycle pulse width modulation control signal, with reference to the two-thirds current waveform, and showing a preheat cycle provided at the beginning of each period.

The half cycle power on times are depicted as solid lines in FIGS. 2–4, and the power switching throughout the operation of the present application takes place at zero cross-over points in accordance with operation of the zero-cross optoisolator triac drive circuit 4. Depending upon the mode of operation and the temperature of the heated fuser roll relative to a target temperature, power is supplied to the heater element in accordance with one of these three power waveforms and at a rate determined by a selected duty cycle or percentage of a selected time period, for example, 10 to 15 seconds, as selected by a second PWM control signal or duty cycle PWM control signal that defines a second modulated power level. Application of a two-out-of-three waveform 14 for a duty cycle portion of a time period (after a preheat cycle 22), as controlled by the duty cycle PWM control signal 21, is illustrated in FIG. 5.

Referring to Table 1, the effect of filament temperature on inrush current for a 1000 W heater filament is illustrated, where $d_{max}$ describes one of the European requirements for controlling flicker, $d_{max}$ being a percentage measure of the change of voltage per unit of time.

TABLE 1

| Heater Filament Temperature (C.) | Inrush Current (A) | $d_{max}$ (%) |
|---|---|---|
| 22 | 55.97 | 6.59 |
| 40 | 51.45 | 6.12 |
| 60 | 50.25 | 5.77 |
| 80 | 46.21 | 5.53 |
| 100 | 43.58 | 5.33 |
| 120 | 40.18 | 4.94 |
| 140 | 38.67 | 4.60 |
| 160 | 34.27 | 4.34 |
| 180 | 31.23 | 4.27 |
| 200 | 29.26 | 4.17 |
| 220 | 26.90 | 3.96 |

The limit for $d_{max}$, as set by the European standard, is 4% and it can be seen that when the heater element is at 22° C. (72° F.), or approximately room temperature, the inrush current causes $d_{max}$ to exceed this limit. Further, if the heater element 2 is turned on with full power when the temperature of the heater element in this example is at any temperature lower than a lower limit temperature of approximately 220° C. (432° F.), the $d_{max}$ limit will be exceeded. Observing that the amount of inrush current reduces with increasing temperature of the heater element, the present application supplies power to the heater element at a level corresponding to a first PWM waveform control signal which is controlled through selection of a particular duty cycle and period corresponding to a duty cycle PWM control signal. This power control avoids exceeding the flicker requirement while rapidly heating the heater element 2. Specific examples of power control of the present application will now be described.

Heater Filament Preheat

Whenever power is initially applied to a heater filament, an inrush current is generated that may result in light flicker, and is particularly evident when applying power to the cold filament of a high power heater. The temperature of a heater filament is subject to large variations sin short time periods, such that when power to the filament is shut off, the filament's temperature may drop below the lower limit temperature for $d_{max}$ within a few seconds. On the other hand, when power is applied to the heater filament, its temperature will quickly rise to a level above the lower limit temperature for $d_{max}$, typically in less than a second. Thus, it is possible for the current in the heater filament to exceed the $d_{max}$ limit, with resulting light flicker, any time during operation of the fuser when the heater element is turned off and subsequently turned back on, including during periodic cycling of the heater element as it is turned off and on, such as during a print job or other powered operations of the fuser.

Figure 6:
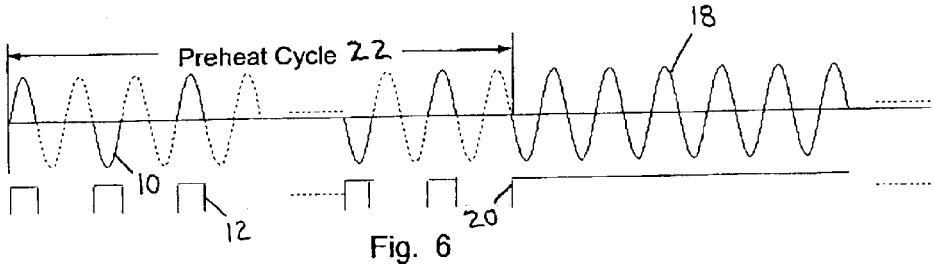
FIG. 6 illustrates a current waveform, including filament preheat, for a duty cycle of a warm-up mode.
Figure 7:
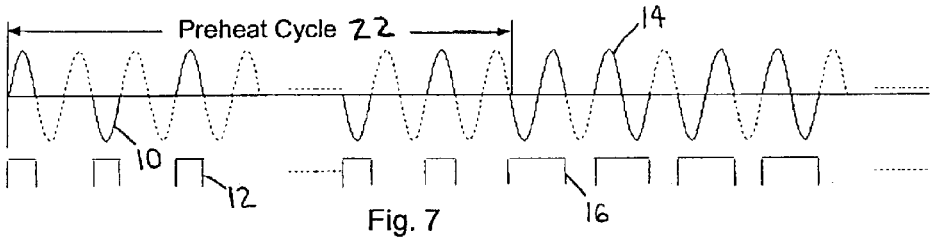
FIG. 7 illustrates a current waveform, including filament preheat, for a duty cycle of a print mode.

Referring to FIG. 5, the power control of the present application provides a discrete, reduced power waveform to the heater element 2 during a preheat cycle 22 (see also FIGS. 6 and 7). The preheat cycle 22 controls the current through the heater element 2 by intermittently disrupting current, thereby increasing a frequency of the voltage drop caused by inrush current at lowered temperatures of the filament, to satisfactorily control flicker. Specifically, the preheat cycle 22 comprises providing power to the filament using the one-out-of-three waveform 10 for a short time period which is long enough for the filament temperature to rise above the $d_{max}$ limit temperature. In the illustrated embodiment, the duration for the preheat cycle 22 is approximately 300 milliseconds. After the preheat cycle 22, either the two-out-of-three waveform 14 or the full waveform 18 may be applied to the heater without causing light flicker.

Figure 8:
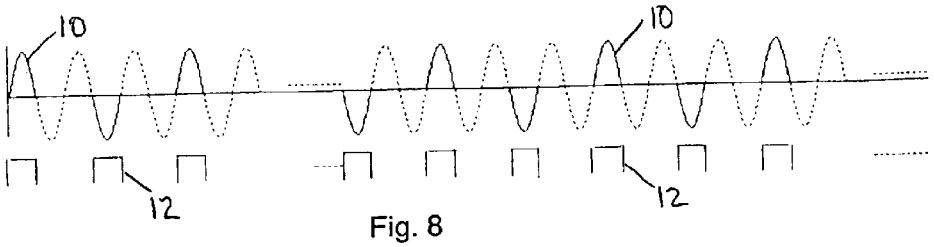
FIG. 8 illustrates a current waveform for a duty cycle of a standby mode, and also for printing in a low power region of operation.

Referring to FIGS. 6–8, current waveforms for a warm-up mode (FIG. 6), a print mode (FIG. 7), and a standby mode (FIG. 8) of the fuser 1 are illustrated. Further description of these modes is provided below. However, it may be noted that the warm-up mode, initiating from room temperature, proceeds to application of the full power waveform 18 after the preheat cycle 22. The print mode includes application of the one-out-of-three waveform 10 and the two-out-of-three waveform 14, depending on whether the fuser temperature is above or below a target temperature. Each application of the two-out-of-three waveform 14 in the print mode is preceded by application of the preheat cycle 22 (FIG. 5). Finally, the standby mode utilizes the one-out-of-three waveform 10 which is not preceded by a preheat cycle in that the standby mode utilizes the same reduced power level as is applied in the preheat cycle and which results in a filament current below the $d_{max}$ limit.

Power Regions

For the purposes of the explanation provided below, power regions are defined for application of particular power levels and power outputs of the heater element wherein a high power region, $T_H$, is triggered when the temperature of the heated fuser roll goes below a low threshold, e.g., a target temperature minus 1° C.; and a low power region, $T_L$, is triggered when the temperature of the heated fuser roll goes above a high threshold, e.g., a target temperature plus 1° C. Power application in the high power region, $T_H$, and the low power region, $T_L$, is controlled by a power switching signal 24 (see FIGS. 10 and 11). The power switching signal 24 is set to 1 during the high power region corresponding to a first set of power level control parameters listed in row $T_H$ in the table of FIG. 9, and the power switching signal 24 is set to zero during the low power region, corresponding to a second set of power level control parameters listed in row $T_L$ in the table of FIG. 9.

The application of power to the heater element during the low and high power regions will vary depending upon the mode of operation of the fuser, such that separate subsets of power level control parameters are provided for the print mode of operation and the standby mode of operation. Additionally, the power level control parameter subsets are comprised of two control components including a waveform component, determined by the waveform PWM control signal, and a duty cycle/period component, determined by the duty cycle PWM control signal. The subsets of parameters in row $T_L$ are selected to provide for a decrease in temperature with application of power to the fuser for the particular mode of operation, and the subsets of parameters in row $T_H$ are selected to provide for an increase in temperature with application of power to the fuser for the particular mode of operation.

Print Mode

As noted above, power is provided to the heater element during the print mode applying either the one-out-of-three waveform 10 or the two-out-of-three waveform 14. The particular waveform applied depends on whether the temperature of the heated fuser roll is below the target print temperature, such that the high power region power level control parameters are applied, or the temperature of the heated fuser roll is above the target print temperature, such that the low power region power level control parameters are applied.

Consider first the low power region, $T_L$, corresponding to the fuser roll temperature exceeding the target temperature. It is necessary for the fuser roll to cool toward the target temperature during this time, and the waveform PWM control signal applies the one-out-of-three waveform 10 to supply a reduced level of power to the heater element. It should be noted that even during cooling of the fuser roll, the duty cycle PWM control signal operates to periodically apply power to the heater element (during the duty cycle portion of the period), and thereby maintain the filament in a warm state while permitting the temperature of the heated fuser roll to decrease. Further, it should be understood that, based on the relationship between inrush current and the heater filament temperature shown in Table 1 above, there exists a maximum cooling time for a given heater element to meet the $d_{max}$ requirement. If the cooling or off time of the heater element exceeds this maximum cooling time, the inrush current produced as a result of the low heater element resistance may cause the $d_{max}$ limit, as specified by the European standards, to be exceeded, thus producing a noticeable affect. Accordingly, if the period is too long and the duty cycle is sufficiently small, a noticeable flicker may occur with the repeated or periodic application of power during the duty cycle. Therefore, to ensure that the $d_{max}$ value remains below the flicker standard, the period of the duty cycle PWM control signal is set to be shorter than the maximum cooling time.

Figure 10:
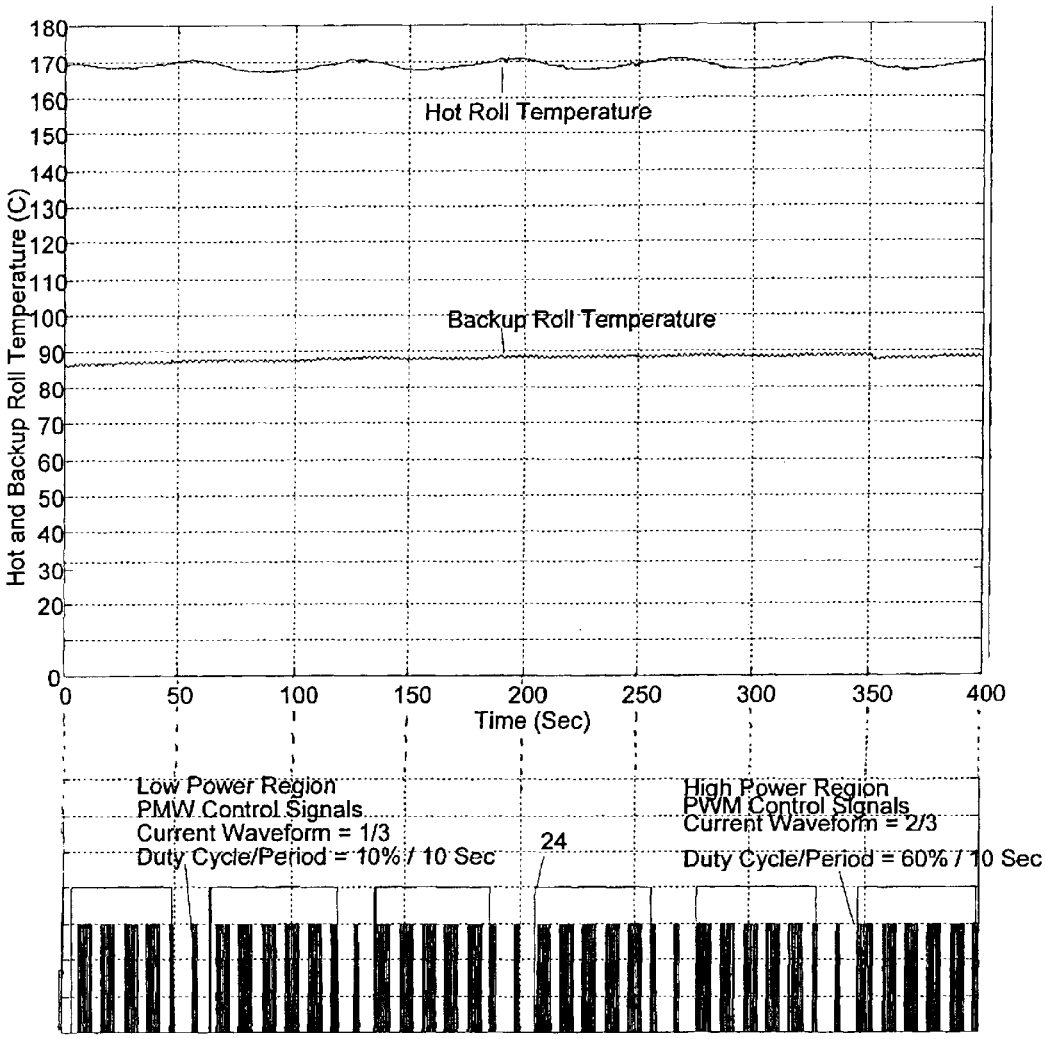
FIG. 10 illustrates the temperature response of a fuser, and the switching provided for a print mode of operation of the present invention in the high power region and low power region.

A specific non-limiting example of application of power to the heater element during operation in the print mode is illustrated in FIG. 10, in which the present application is applied to a heated fuser roll for a color printer, the heated roll having a 46 mm roll diameter and including a 1000 W heater element, and cooperating with a 40 mm diameter backup roll. Considering first an operation of the power control in the low power region, $T_L$, (i.e., during the time that the fuser roll temperature exceeds the target print temperature, 170° C. in this example) the power switching signal 24 is set to zero to cause the one-out-of-three waveform 10 to be applied during a 10% duty cycle portion of a period of 10 seconds. For this example, the period is set to a relatively short time, i.e., 10 seconds, so that the period is shorter than the maximum cooling time. Also, the duty cycle is set to a relatively low value of 10%, permitting cooling of the fuser roll while at the same time providing sufficient power to heat and maintain the temperature of the heater filament at an elevated level.

The high power region, $T_H$, is similar to the low power region, $T_L$, in that the period of the duty cycle PWM control signal is set shorter than the maximum cooling time for the heater element. The switching signal 24 is set to 1 to cause the two-out-of-three waveform 14 to be applied to supply power to the heater element. In the illustrated example of FIG. 10, power is applied to the heater element using a period of 10 seconds and a duty cycle of 60%. The duty cycle for the high power region, $T_H$, is determined by the requirement for tight temperature control and is selected with reference to such factors as the thermal load, power variations caused by low line AC voltage, and the particular power characteristics of the heater element.

It should be apparent that accurate selection of the duty cycle is important in that selection of a duty cycle that is too long may result in temperature overshoot, as too much power may be applied to the fuser roll in a short time. Alternatively, selection of a duty cycle that is too short may not meet the power requirements for maintaining the fuser roll near its target temperature during a print fusing operation. Accordingly, the duty cycle for the high power region, $T_H$, must be carefully selected to provide a narrow temperature operating window under all operating conditions wherein the operating window for the illustrated example is approximately 4° C., i.e., 2° C. above and 2° C. below the target temperature, for operation in both the high and the low power regions.

Standby Mode

Figure 11:
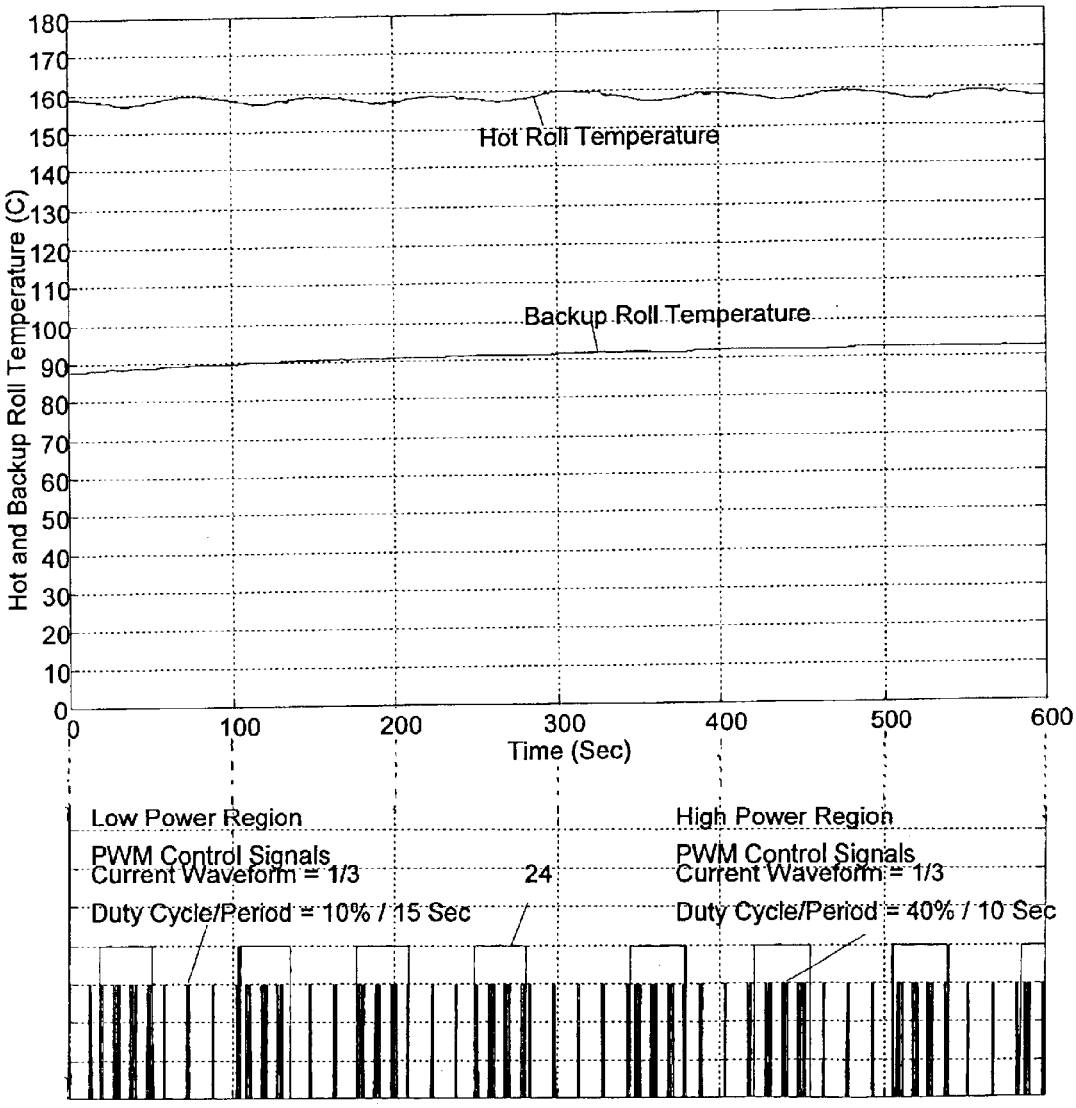
FIG. 11 illustrates the temperature response of a fuser, and the switching provided for a standby mode of operation of the present invention in the high power region and low power region.

Power is supplied to the heater element by applying the one-out-of-three waveform 10 to the heating element for both the low power region, $T_L$, and the high power region, $T_H$, during the standby mode. However, different periods and duty cycles are defined by the duty cycle PWM control signal for the different power regions. Specifically, as seen in FIG. 11, for operation in the low power region, $T_L$, when the temperature of the fuser roll exceeds the target standby temperature, the switching signal 24 is set to zero and a duty cycle of 10% is applied, operating with a period of 15 seconds, in order to permit the fuser roll temperature to decrease. For operation in the high power region, $T_H$, when the temperature of the fuser roll is below the target standby temperature, which in this example is 158° C., the switching signal 24 is set to 1 and a duty cycle of 40% is applied, operating with a period of 10 seconds. As with the print mode, the power control of the present application is capable of maintaining the fuser roll temperature within a narrow window of 2° C. above or below the standby target temperature.

Warm-up Mode

Figure 12:
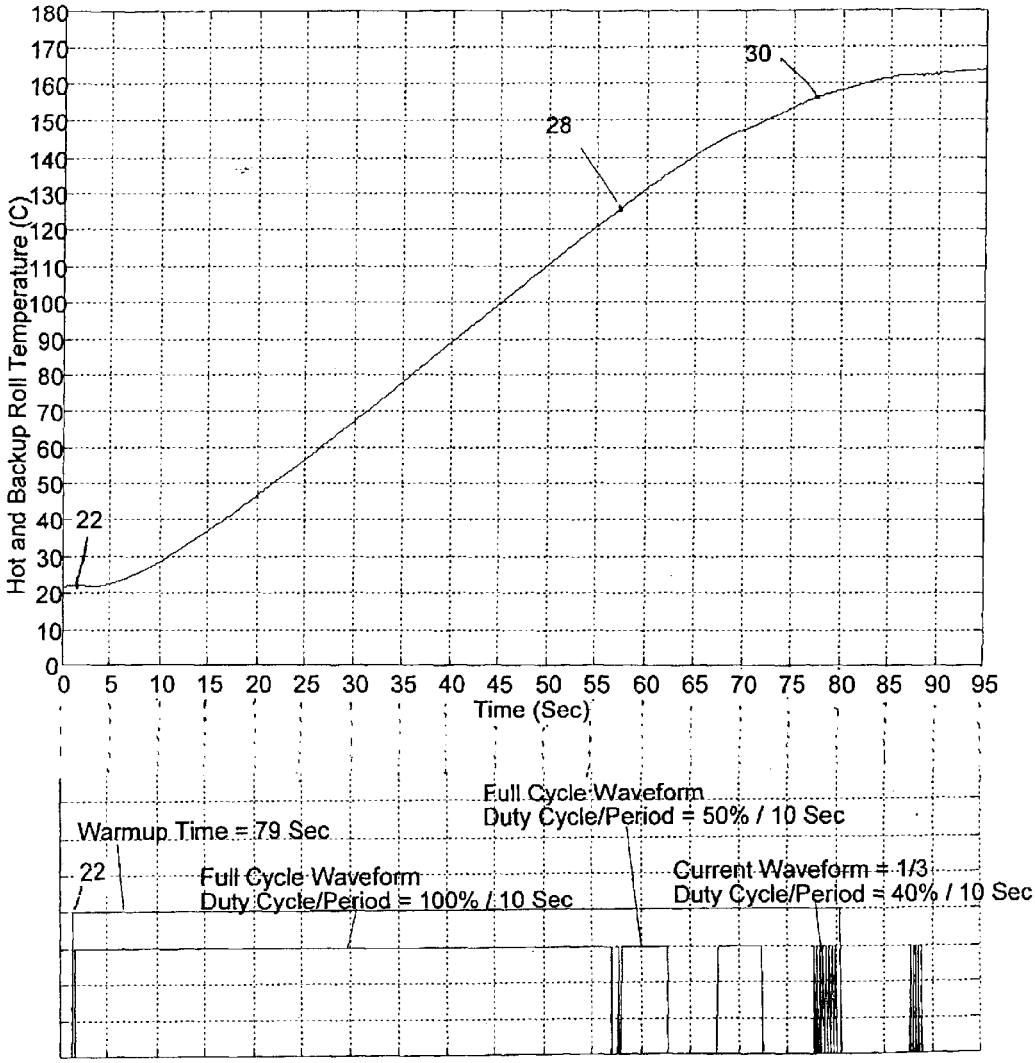
FIG. 12 illustrates the temperature response of a fuser during a warm-up mode of operation of the present invention.

Referring to FIG. 12, the warm-up mode includes an initial preheat cycle 22, during which the heater element is initially heated from room temperature to increase the electrical resistance of the heater element under a low power condition provided by the one-out-of-three waveform 10. Subsequent to the approximately 300 millisecond preheat cycle 22, the waveform PWM control signal applies the full power three-out-of-three waveform 18 at 100% duty cycle to provide a rapid heating of the fuser roll, and thereby minimize the first copy or print time. However, in order to avoid temperature overshoot, which would necessitate an extended time to allow the fuser to cool down before printing, the power control of the present application decreases the power supplied to the heater element in stages, by incrementally decreasing the duty cycle, as controlled by the duty cycle PWM control signal. Specifically, following the preheat cycle 22, the fuser roll is heated during a first stage at a first power level comprising the full power waveform 18 and 100% duty cycle with a 10 second period from room temperature to 125° C. (see point 28), at which time the duty cycle is reduced to 50% with a 10 second period, applying the full power waveform 18, up to a temperature of 154° C. (see point 30) for a second stage at a second power level. The time required to reach 154° C. in this example is approximately 79 seconds. It should be noted that during second stage heating at the 50% duty cycle, a preheat cycle 22 is applied prior to each periodic application of the full power waveform. The final temperature increase to the target temperature is achieved during a third stage at a third power level applying a one-out-of-three waveform 10 and 40% duty cycle with a period of 10 seconds, increasing the fuser roll temperature to a target temperature of either 158° C. for the standby mode or 170° C. for the print mode for the illustrated example.

From the above description, it should be apparent that the present application provides a dual pulse width modulation control method whereby power to a high power electrical component may be accurately controlled while minimizing adverse affects of flicker and harmonics associated with prior power control arrangements. Further, the combined use of two PWM controls in the present application permits a fuser design incorporating a high power heater element for providing reduced fuser warm-up times while also enabling improved temperature control for operation within a narrow temperature window for improved print quality.

What we claim is:

1. A method of controlling power to an electrical load comprising:

supplying power from a power source;

modulating an output from said power source to provide power at a first modulated power level to power said electrical load; and modulating said first modulated power level in accordance with a second modulated power level varying the rate at which said first modulated power level is provided to control the power provided to said electrical load.

2. The method of claim 1 wherein said first modulated power level is defined by a selected one of a plurality of waveforms.

3. The method of claim 2 wherein said power from said power source is cyclical and said waveforms each provide a discrete power level and each waveform is defined by a waveform length and a waveform power segment, said waveform length comprising a predetermined number of half cycles and said waveform power segment comprising a selected number of half cycles of said waveform length for supplying power from said power source to said electrical load.

4. The method of claim 3 wherein said waveforms all have the same waveform length and each said waveform has a unique waveform power segment.

5. The method of claim 4 wherein said selected one of a plurality of waveforms is selected from a group of waveforms having a waveform length equal to three and comprising a one-out-of-three half cycle waveform, a two-out-of-three half cycle waveform and a three-out-of-three half cycle waveform.

6. The method of claim 1 wherein said second modulated power level is defined by a duty cycle.

7. The method of claim 6 wherein said second modulated power level is further defined by a period for said duty cycle.

8. The method of claim 7 including initially providing a reduced power level to said electrical load at the beginning of each duty cycle.

9. The method of claim 1 wherein said electrical load comprises a heater element.

10. The method of claim 9 wherein said heater element provides heat to a fuser, and including sensing a temperature of said fuser above a predetermined target temperature and continuing to supply power to said heater element while causing a decrease in the temperature of said fuser.

11. A method of controlling power to a heater element comprising:

supplying AC current from a power source;

producing a waveform pulse width modulation control signal to define a plurality of first modulated power levels to power said heater element; and producing a duty cycle pulse width modulation control signal to define a second modulated power level to control application of a selected one of said first modulated power levels to said heater element.

12. The method of claim 11 wherein said waveform pulse width modulation control signal defines three AC current waveforms for providing one-third power, two-thirds power and full power to said heater element.

13. The method of claim 12 wherein said duty cycle pulse width modulation control signal defines a time period for periodically applying one of said three AC current waveforms.

14. The method of claim 11 wherein said heater element provides heat to a fuser and including sensing a temperature of said fuser above a predetermined target temperature and continuing to supply power to said heater element while causing a decrease in the temperature of said fuser.

15. A method of controlling a heater element comprising:

supplying power from a power source;

sensing a temperature controlled by said heater element;

comparing said sensed temperature to a predetermined temperature;

supplying said power to said heater element in accordance with a first switching signal providing a first set of power level control parameters when said sensed temperature is below said predetermined temperature; and supplying power to said heater element in accordance with a second switching signal providing a second set of power level control parameters when said sensed temperature is above said predetermined temperature to control said sensed temperature to said predetermined temperature wherein the power supplied to said heater element in accordance with said second set of power level control parameters is reduced from the power supplied by said first set of power level control parameters.

16. The method of claim 15 wherein said heater element is controlled in accordance with different modes of operation, and a separate subset of power level control parameters is provided for each of said different modes of operation.

17. The method of claim 16 wherein said different modes of operation correspond to standby and print modes of operation for a heater element in a fuser.

18. The method of claim 16 wherein each said subset of power level control parameters comprises first and second pulse width modulation control components.

19. The method of claim 18 wherein said first and second pulse width modulation control components comprise:

i) a waveform component determined by a waveform pulse width modulation control signal to define a first modulated power level; and ii) a duty cycle component determined by a duty cycle pulse width modulation power control signal to define a second modulated power level to control application of said first modulated power level to said heater element.

20. A method of controlling power to an electrical load comprising:

supplying power from a power source;

controlling supply of said power at a predetermined power level;

further controlling supply of said power to an electrical load in accordance with a duty cycle pulse width modulation signal for providing a periodic application of power at said predetermined power level;

providing a preheat defined by a lower power level than said predetermined power level; and wherein said preheat is provided prior to individual periods of said periodic application of power.

21. The method of claim 20 wherein said predetermined power level is controlled in accordance with a waveform pulse width modulation signal.

22. The method of claim 21 wherein said waveform pulse width modulation signal defines a plurality of discrete power levels.

23. The method of claim 22 wherein each said discrete power level is defined by a predetermined number of half cycles of said power from said power source, said predetermined number of half cycles periodically repeating.

24. The method of claim 23 wherein said predetermined number of half cycles periodically repeats every three half cycles of said power from said power source.

25. The method of claim 24 wherein said power levels are defined by one-out-of-three half cycles, two-out-of-three half cycles and three-out-of-three half cycles, and said power level for said preheat comprises said one-out-of-three half cycle power level.

26. The method of claim 20 wherein said periodic application of power by said duty cycle is performed with reference to a selected time period.

27. The method of claim 26 wherein said preheat is applied prior to substantially each of said periods of said duty cycle for said predetermined power level.

28. A method of controlling power to a heater element in an electrical device comprising:

supplying power from a power source to said heater element;

defining a high threshold temperature for said electrical device;

determining a temperature of said electrical device above said high threshold temperature to trigger a low power region; and continuing to supply power to said heater element in said low power region while causing a decrease in the temperature of said electrical device.

29. The method of claim 28 further comprising defining a low threshold temperature for said electrical device, determining a temperature of said electrical device below said low threshold temperature to trigger a high power region, and supplying power to said heater element in said high power region causing an increase in the temperature of said electrical device.

30. The method of claim 29 wherein each of said low and high power regions include power level control parameters including a waveform component and a duty cycle component.

31. A method of controlling a heater element in an electrical device comprising:

defining a target temperature for said electrical device; and supplying power from a power source to heat said electrical device from substantially a room temperature wherein said power is supplied at a first power level during a first stage up to a first predetermined temperature less than said target temperature, said power is supplied at a second power level, less than said first power level, during a second stage up to a second predetermined temperature greater than said first predetermined temperature and less than said target temperature, and said power is supplied at a third power level, less than said second power level up to said target temperature.

32. The method of claim 31 wherein said power levels are provided by modulating an output from said power source to provide power at a first modulated power level, and modulating said first modulated power level to control the power provided to said heater element at said first modulated power level in accordance with a second modulated power level.

33. The method of claim 32 wherein said first modulated power level is defined by a selected one of a plurality of waveforms.

34. The method of claim 33 wherein said second modulated power level is defined by a duty cycle and a period for said duty cycle for applying said selected one of said plurality of waveforms.

35. Heating control apparatus for connecting and disconnecting AC power from an AC power source at zero crossings of said AC power comprising:

a switching device that is selectively turned on and off;

a heater element connected to said AC power source via said switching device;

a zero-cross driving circuit for driving said switching device at zero-cross points of said power source; and control means providing a dual pulse width modulation control signal for controlling said driving circuit, said signal being asynchronous with said AC power whereby said switching device is turned on and off for half cycles of said AC power corresponding to said signal, said dual pulse width modulation control signal comprising a first waveform component providing selected half cycles of said AC power, and a second duty cycle/period signal component providing said selected half cycles of said AC power for a selected duty cycle portion of a time period.

36. The heating control apparatus of claim 35 wherein said waveform component provides a repeating pattern formed of three half cycles.

37. The heating control apparatus of claim 36 wherein said repeating pattern causes said switching device to selectively provide current to said heater element one-out-of-three half cycles, two-out-of-three half cycles and three-out-of-three half cycles.

38. A method of controlling power to an electrical load comprising:

supplying power from a power source;

modulating an output from said power source to provide power at a first modulated power level to power said electrical load, said first modulated power level comprising a selected one of a plurality of waveforms;

modulating said first modulated power level to control the power provided to said electrical load at said first modulated power level in accordance with a second modulated power level; and wherein said power from said power source is cyclical and said waveforms each provide a discrete power level and each waveform is defined by a waveform length and a waveform power segment, said waveform length comprising a predetermined number of half cycles and said waveform power segment comprising a selected number of half cycles of said waveform length for supplying power from said power source to said electrical load.

* * * * *